US010865601B2

(12) United States Patent
Zeng et al.

(10) Patent No.: US 10,865,601 B2
(45) Date of Patent: Dec. 15, 2020

(54) WINDOW COVERING

(71) Applicant: Nien Made Enterprise Co., Ltd., Taichung (TW)

(72) Inventors: Jian Zeng, Dongguan (CN); Keng-Hao Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 245 days.

(21) Appl. No.: 16/109,760

(22) Filed: Aug. 23, 2018

(65) Prior Publication Data

US 2019/0119976 A1 Apr. 25, 2019

(30) Foreign Application Priority Data

Oct. 19, 2017 (CN) ..... 2017 2 1348067 U

(51) Int. Cl.
*E06B 9/325* (2006.01)
*E06B 9/322* (2006.01)
*E06B 9/38* (2006.01)

(52) U.S. Cl.
CPC ..... *E06B 9/325* (2013.01); *E06B 9/322* (2013.01); *E06B 9/38* (2013.01)

(58) Field of Classification Search
CPC . E06B 9/325; E06B 9/322; E06B 9/38; E06B 9/34; E06B 9/304; E06B 9/307
See application file for complete search history.

(56) References Cited

U.S. PATENT DOCUMENTS 271,691 A * 2/1883 De Quillfeldt ..... E06B 9/90 160/296
2,134,405 A * 10/1938 Hulshizer ..... E21B 19/081 188/82.2
5,494,093 A * 2/1996 Eiterman ..... E05D 13/003 160/300
7,455,157 B2 * 11/2008 Kimes ..... F16D 41/12 192/108
10,451,145 B2 * 10/2019 Chen ..... F16F 9/125
2012/0048485 A1 * 3/2012 Fu-Lai ..... E06B 9/322 160/331
2017/0138123 A1 * 5/2017 Chen ..... E06B 9/322
2017/0218698 A1 * 8/2017 Chen ..... E06B 9/307

* cited by examiner

*Primary Examiner* — Beth A Stephan
(74) *Attorney, Agent, or Firm* — Winston Hsu

(57) ABSTRACT

A window covering includes a fixed rail, a covering material, a lifting cord and a winding mechanism, wherein the covering material is positioned under the fixed rail, and the winding mechanism includes a reel, a rotating member and a stopper. The reel is adapted to wind up or release the lifting cord, in order to drive the covering material to move toward the fixed rail to fold, or to move away from the fixed rail to unfold. The rotating member passes through the reel. The stopper is operably pivoted relative to the rotating member. When the rotating member rotates independently from the reel, the stopper is driven to pivot, and is protruded from a surface of the rotating member, and the stopper would abut against a block of the fixed rail to stop the rotation of the rotating member. Therefore, when a covering material of the window covering is unfolded and meets an obstacle, the covering material could stop unfolding automatically.

10 Claims, 8 Drawing Sheets

WINDOW COVERING

BACKGROUND OF THE INVENTION

1. Field of the Invention

The present disclosure relates generally to a window covering which is operable to vertically move, and more particularly to a window covering which is operable to stop unfolding while meeting an obstacle.

2. Description of the Prior Art

A window covering operable to vertically move substantially includes a fixed rail, a covering material positioned under the fixed rail and a lifting cord. The lifting cord has one end fixed on the bottom of the covering material after passing through the covering material, and another end thereof is wound around or released from a winding mechanism installed in the fixed rail, in order to fold or unfold the covering material, whereby to change a covering area. In addition, when a rotating shaft of the winding mechanism drives a reel to rotate to wind up the lifting cord, the covering material would be moved upward close to the fixed rail to fold; when the reel is driven by the weight of the covering material to rotate, the covering material would be moved downward away from the fixed rail to unfold.

However, when the covering material is unfolded downward to meet an obstacle, the bottom of the covering material would be tilted by the obstacle, after contacting the obstacle. If the covering material could not stop unfolding in time, one side of the covering material, which is not blocked, would keep unfolding, so that the tilting angle of the bottom of the covering material would be increased. At the same time, for the covering material keeps unfolding, the reel is driven to keep rotating, and therefore the lifting cord is released continuously. Accordingly, the lifting cord in the fixed rail would be scattered, and is not easy to be rewound after the obstacle is removed. Furthermore, the lifting cord would be twisted, and thereby the whole window covering could not be normally operated.

SUMMARY OF THE INVENTION

In view of the above, the primary objective of the present invention provides a window covering. When a covering material of the window covering is unfolded and meets an obstacle, the covering material could stop unfolding automatically.

To achieve the above objective, the present invention provides a window covering including a fixed rail, a covering material, a lifting cord and a winding mechanism, wherein the covering material is positioned under the fixed rail, and the winding mechanism includes a rotating member and a reel. The lifting cord passes through the covering material and is connected to the reel. The reel is driven to rotate to wind up or release the lifting cord, in order to drive the covering material to move toward the fixed rail to fold, or to drive the covering material to move away from the fixed rail to unfold. The rotating member passes through the reel, and is able to selectively rotate independently from the reel, or to rotate along with the reel in the same direction synchronously. The winding mechanism further includes a stopper which is operably pivoted relative to the rotating member. A block is positioned in the fixed rail, and is stationary relative to the fixed rail; when the rotating member rotates independently from the reel, the stopper is driven to pivot, and is protruded from a surface of the rotating member, and the stopper would abut against the block to stop the rotation of the rotating member.

In embodiments of the present invention, the rotating member includes a rotating base, and the stopper includes a detent; one end of the detent is a pivoting portion pivotably connected to the rotation base, and another end of the detent is formed as an abutting portion; when the rotating base is driven to rotate independently from the reel, the detent is driven by the rotating base, and pivots on the pivoting portion, in order to drive the abutting portion of the detent to move outward from a surface of the rotating base, and thereby the abutting portion would abut against the block, so as to stop rotating the rotating base.

In embodiments of the present invention, the reel has a bore and an opening; the bore is formed in the reel, and the opening is formed on a surface of the reel, wherein the opening and the bore communicate with each other and are positioned corresponding to the detent; the rotating base enters into the bore, and the detent is driven by the rotating base to selectively go into the opening or go out of the opening.

In embodiments of the present invention, the rotating base includes a disk; the pivoting portion of the detent is pivotably connected to the disk; the disk enters into the bore of the reel, and the abutting portion of the detent is positioned in the opening of the reel.

In embodiments of the present invention, the opening of the reel is adjacent to the surface of the rotating base; when the rotating member and the reel rotate synchronously in the same direction, the detent goes into the opening, and the abutting portion of the detent is attached on the surface of the rotating base; when the rotating member rotates independently from the reel, and the detent is driven by the rotating base to face toward the opening, the detent pivots and is guided by the opening, and thereby the abutting portion goes out of the surface of the rotating base, in order to protrude from the surface of the reel through the opening of the reel, whereby to abut against the block to stop rotating the rotating base.

In embodiments of the present invention, the reel has a side hole; the side hole is defined by a side wall which is an abutting surface, and the side hole communicates with the bore; the rotating base has a hump located in the side hole, and the width of the hump is less than the width of the side hole; when the hump abuts against the abutting surface of the side hole, the rotating base and the reel could rotate synchronously in the same direction.

In embodiments of the present invention, the side hole is further defined by another side surface which is a restricting surface facing to the abutting surface; when the rotating base is driven to rotate independently from the reel, the hump in the side hole is moved from the abutting surface to the restricting surface, in order to restrict the pivoting range of the detent driven by the rotating base.

In embodiments of the present invention, the rotating base has a connecting groove recessed in a radial direction thereof, and the abutting portion of the detent is rotatably positioned in the connecting groove; when the abutting portion of the detent rotates independently from the connecting groove, the detent pivots on the pivoting portion, and the abutting portion of the detent is driven to protrude from the surface of the rotating base.

In embodiments of the present invention, the rotating member further includes a rotating shaft, and the rotating base is fixed on the rotating shaft, in order to be driven by the rotating shaft to rotate.

In embodiments of the present invention, the window covering further includes a seat fixed in the fixed rail, and the reel is rotatably positioned on the seat, wherein the seat has the block which is protruded.

According to one aspect of the present invention, when the covering material contacts the obstacle during unfolding from the fixed rail, one end of the stopper is adapt to abut against the block which is stationary, whereby to force the rotating shaft to stop rotating, and therefore the covering material stop unfolding, in order to prevent the lifting cord from continuously being released.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
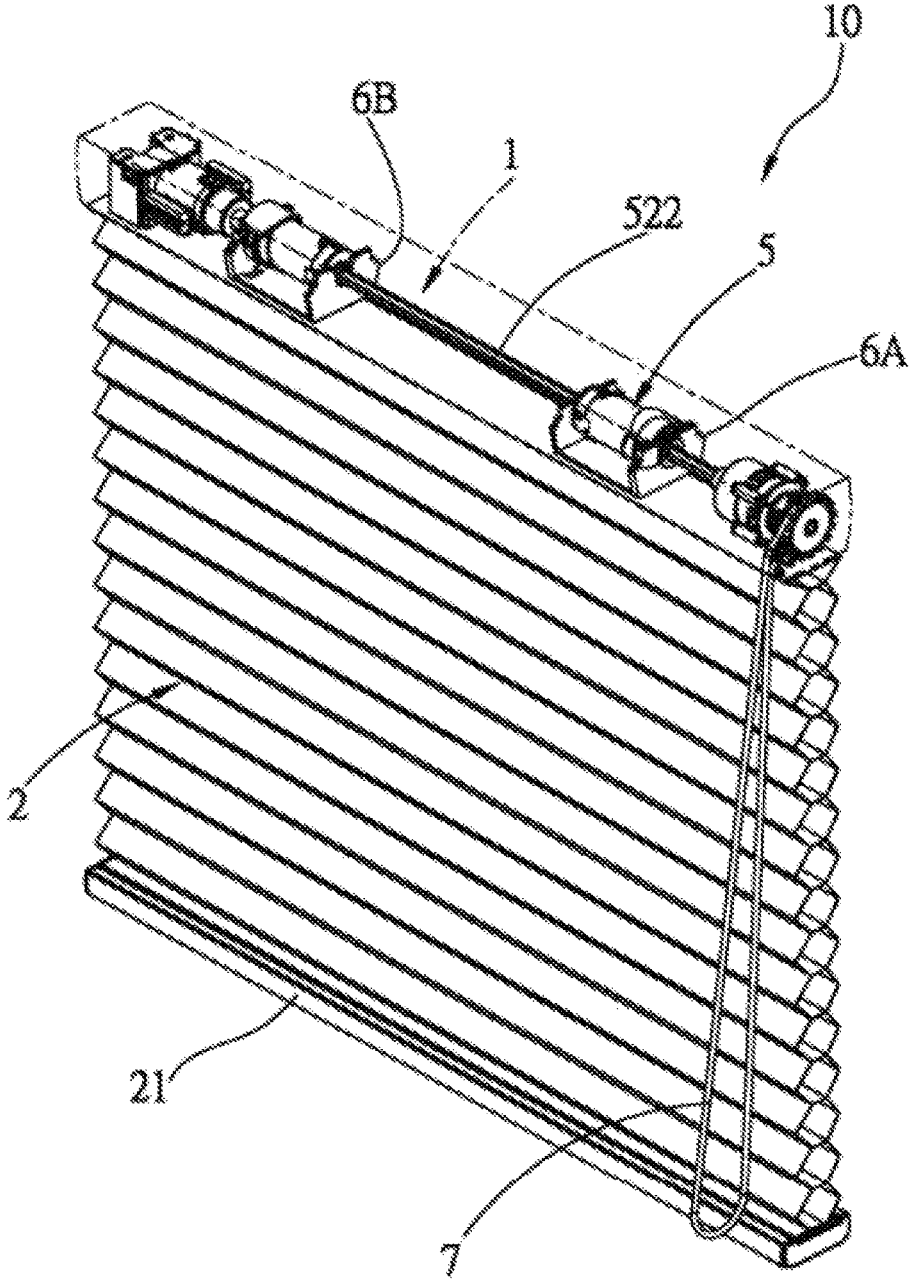
FIG. 1 is a perspective view of a window covering according to one preferred embodiment of the present invention.
Figure 2:
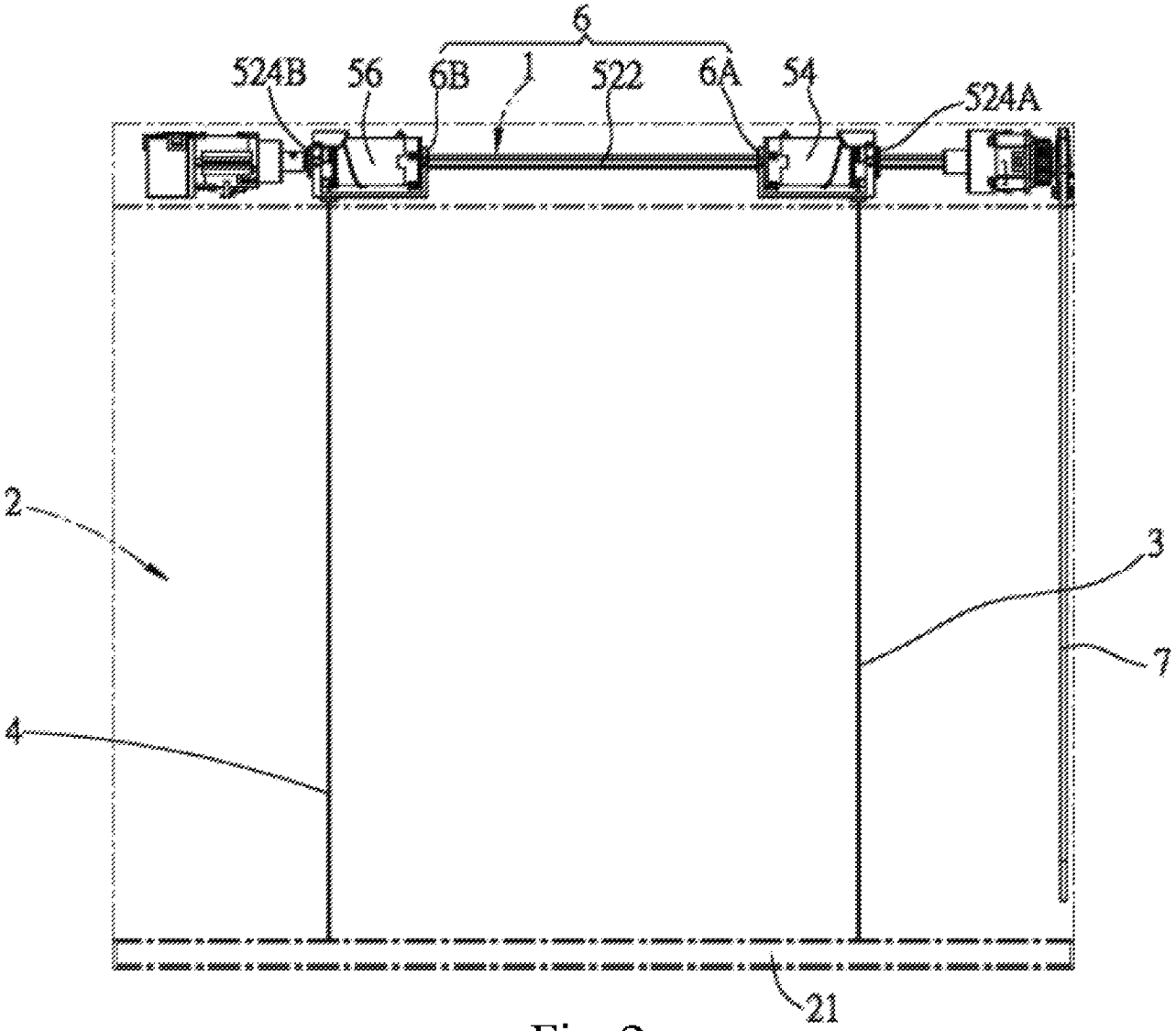
FIG. 2 is a front view of FIG. 1.

For easily understanding the present invention, several embodiments and accompanying drawings are illustrated as the following. Referring to FIG. 1 and FIG. 2, according to one embodiment of the present invention, a window covering 10 includes a fixed rail 1, a covering material 2, a first lifting cord 3, a second lifting cord 4, a winding mechanism 5 and a seat 6. The fixed rail 1 is adapt to be fixed on an architecture or a window frame thereof, and the covering material 2 for covering light is positioned under the fixed rail 1. The covering material 2 of the present embodiment, for example, is a cellular shade, but is not limited thereto. The first lifting cord 3 and the second lifting cord 4 respectively have one end connected to the winding mechanism 5 positioned in the fixed rail 1, and another end thereof is fixed on a bottom 21 of the covering material 2 after passing through the window covering 2. When the winding mechanism 5 winds up or releases the lifting cords, the covering material 2 could be driven to move close to the fixed rail 1, or move away from the fixed rail 1, whereby to fold the covering material 2 or to unfold the covering material 2.

Referring to FIG. 3 to FIG. 6, the winding mechanism 5 includes a rotating member, two reels and a plurality of stoppers. In the present embodiment, the rotating member, which is designated as 52, includes a rotating shaft 522 and two rotating bases 524A and 524B. The rotating shaft 522 is a polygonal shaft, and the two rotating bases 524A and 524B are coaxially fixed on the rotating shaft 522 in interval. One end of the rotating shaft 522 is connected to a driving mechanism, and when the rotating shaft 522 is operated by the driving mechanism to rotate, the two rotating bases 524A and 524B could be driven to rotate simultaneously. The driving mechanism could be a manually or electrically controlled structure. In the present embodiment, the rotating shaft 522 is operated by pulling a cordloop to rotate.

The two reels in the present embodiment are shown as a first reel 54 and the second reel 56 respectively, wherein the first reel 54 and the second reel 56 are sleeved on the rotating shaft 522 in a manner that the two reels 54, 56 could rotate relative to the rotating member 52. The first reel 54 is connected to one end of the first lifting cord 3, the second reel 56 is connected to one end of the second lifting cord 4, and another ends of the first lifting cord 3 and the second lifting cord 4 are connected to the bottom 21 of the covering material 2. Whereby, when the first reel 54 and the second reel 56 are driven to rotate, the first reel 54 and the second reel 56 could wind up or release the first lifting cord 3 and the second lifting cord 4, respectively, in order to stably drive the covering material 2 to fold or unfold.

In the present embodiment, the number of the seat 6 is two, and they are shown as a first seat 6A and a second seat 6B, wherein the first seat 6A is corresponding to the first reel 54, and the second seat 6B is corresponding to the second reel 56. The first seat 6A is the same as the second seat 6B, so that the first seat 6A is, as an example, illustrated thereafter. The first seat 6A has a bottom board 62 and two vertical side boards 64 connected to the bottom board 62, wherein each of the side boards 64 has a notch 642. The winding mechanism 5 further includes a block is positioned in the fixed rail, and is stationary relative to the fixed rail. The block in the present invention is shown as a block 622 positioned on and protruded from a surface of the bottom board 62.

The structure of the first reel 54 is the same as that of the second reel 56, whereby the first reel 54 would be illustrated as an example thereafter. The first reel 54 is adapted to wind up the first lifting cord 3 or release the first lifting cord 3 therefrom. One side of the first reel 54 forms a neck 541 which could cross over the notch 642 of one of the side boards 64 of the first seat 6A. A cord-fixing portion 542 positioned on the surface of another side of the first reel 54 is adapted to fixedly connect to one end of the first lifting cord 3. The first reel 54 has a bore 543 formed therein and along the longitudinal direction thereof, and a plurality of openings 544 and side holes 545 radially formed on the surface thereof. The openings 544 and the side holes 545 could be formed in intervals, and could respectively communicate the bore 543. The side holes 545 is defined by at least two surfaces; one side surface of the side holes 545 as an abutting surface 5451, and another side surface thereof as a restricting surface 5452.

In the present embodiment, the rotating base 524A of the rotating member 52 is positioned corresponding to the first reel 54, and the rotating base 524B is positioned corresponding to the second reel 56. For the two rotating bases have the same structure, the rotating base 524A corresponding to the first reel 54 is illustrated as an example thereafter. The rotating base 524A has a protruded shaft 5241 and a disk 5242 formed on two opposite sides thereof, wherein the protruded shaft 5241 could cross over the notch 642 of the other side board 64 of the seat 6A; the disk 5242 is inserted in the bore 543 of the first reel 54. The rotating base 524A further includes a communicating polygonal hole 5243 which a polygonal shaft of the rotating shaft 522 passes through, and therefore the rotating base 524A and the first reel 54 are positioned co-axially. When the rotating shaft 522 is driven to rotate, the rotating base 524A could be driven to rotate relative to the first reel 54. In the present embodiment, the rotating base 524A further includes a plurality of humps 5244 and connecting grooves 5245 positioned on the rim of the disk 5242. Each of the humps 5244 is in the corresponding side hole 545 of the first reel 54, and the hump 5244 could abut against the abutting surface 5451 of the side hole 545, in order to rotate along with the first reel 54 synchronously in the same direction. The width of the hump 5244 is less than the width of the side hole 545, and the hump 5244 is only able to move in a range of the width of the side hole 545. When the rotating base 524 rotates independently from the first reel 54, the hump 5244 is moved from the abutting surface 5451 to the restricting surface 5452, so as to restrain the rotating range of the rotating base 524A rotating independently from the first reel 54. Furthermore, the bottom of the connecting groove 5245 is curved.

In the present embodiment, the stopper is presented as a detent 58; one end of the detent 58 is a pivoting portion 581 with a curved surface, and another end thereof is formed an abutting portion 582. The pivoting portion 581 of detent 58 is inserted in the corresponding connecting groove 5245 on the rotating base 524A, and the detent 58 could pivot relative to the rotating base 524A. The abutting portion 582 of detent 58 is located in the corresponding opening 544 of the first reel 54.

Figure 3:
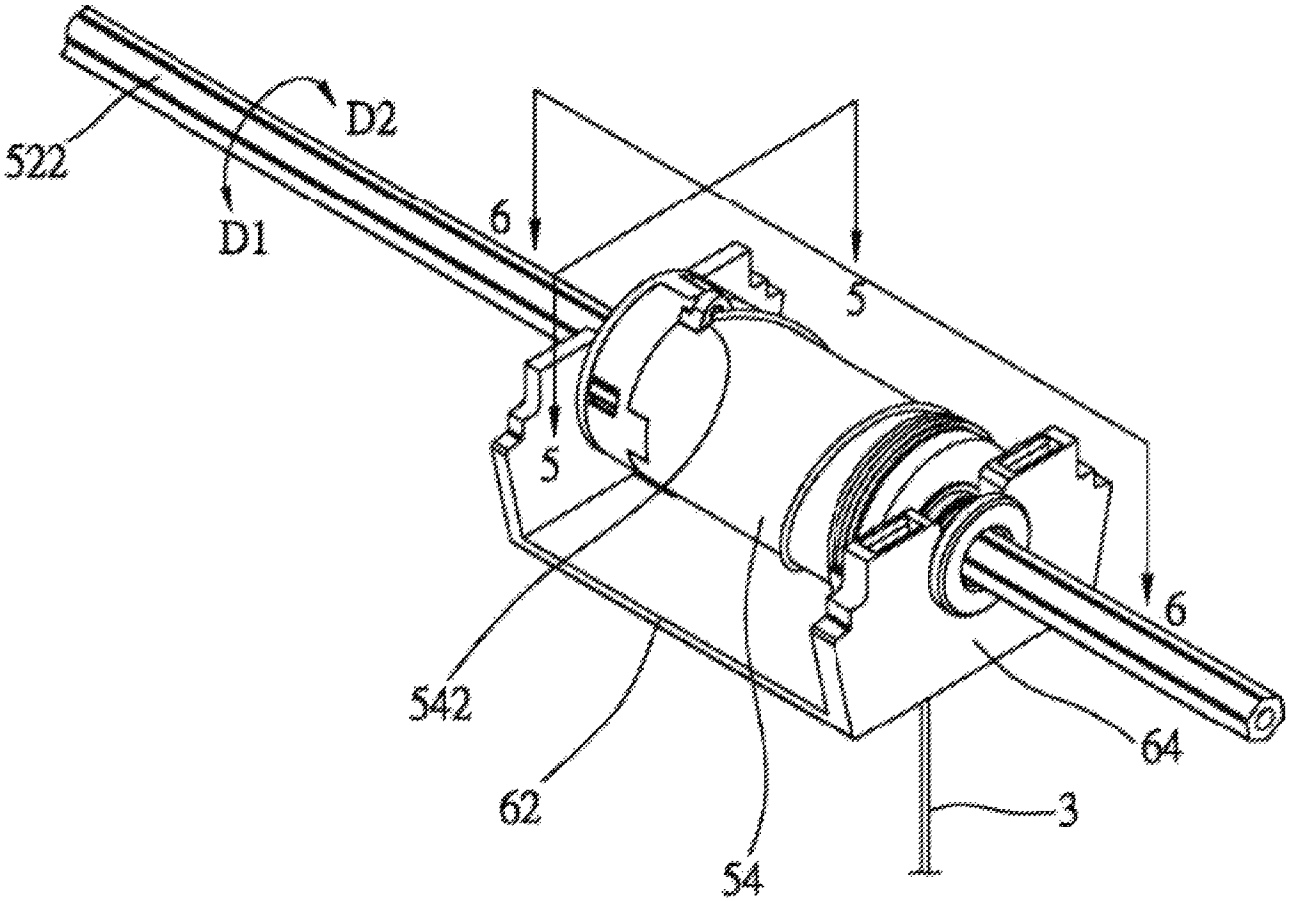
FIG. 3 is a perspective view of a winding mechanism included in the window covering shown in FIG. 1.
Figure 4:
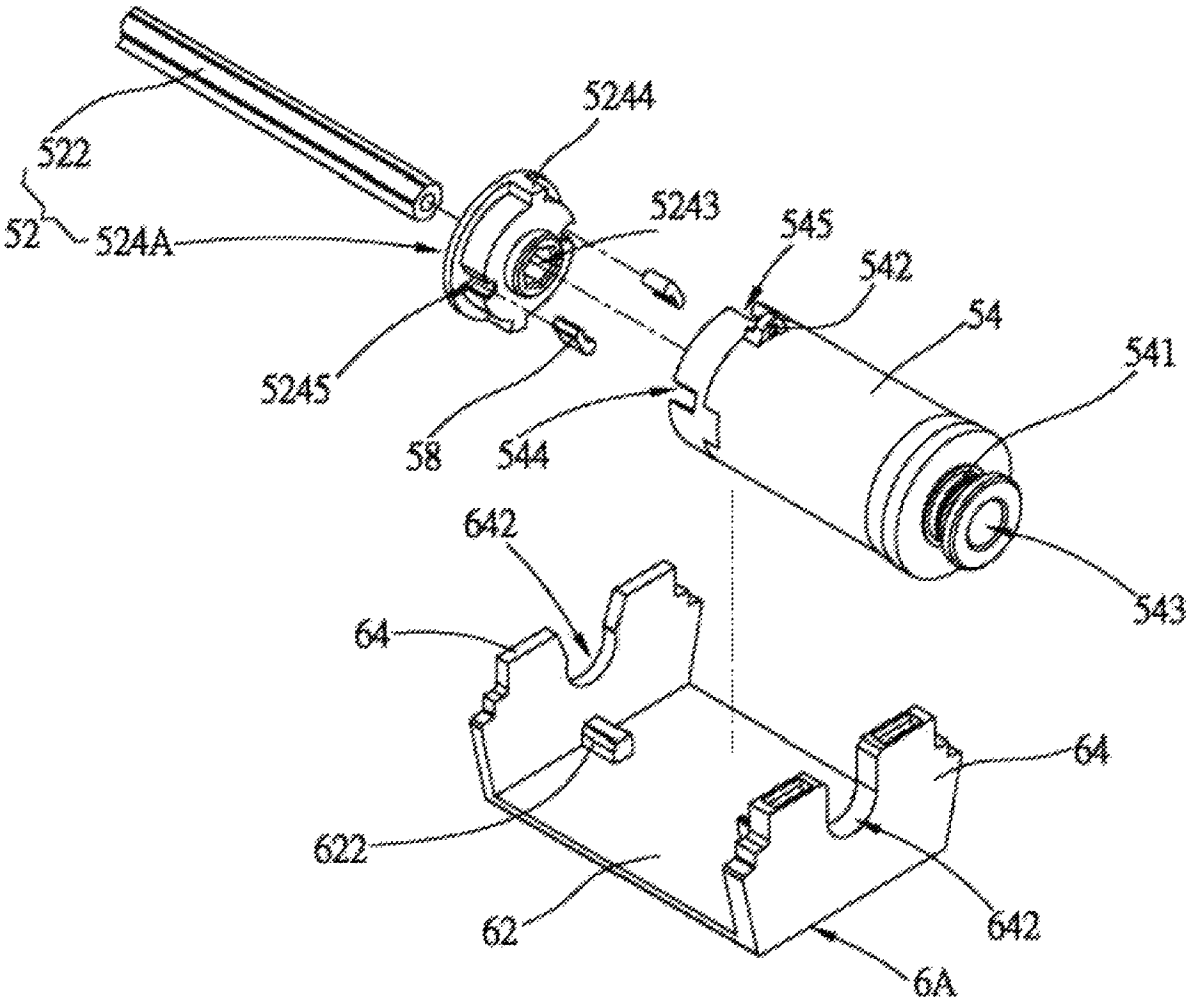
FIG. 4 is an exploded view of FIG. 3.
Figure 5:
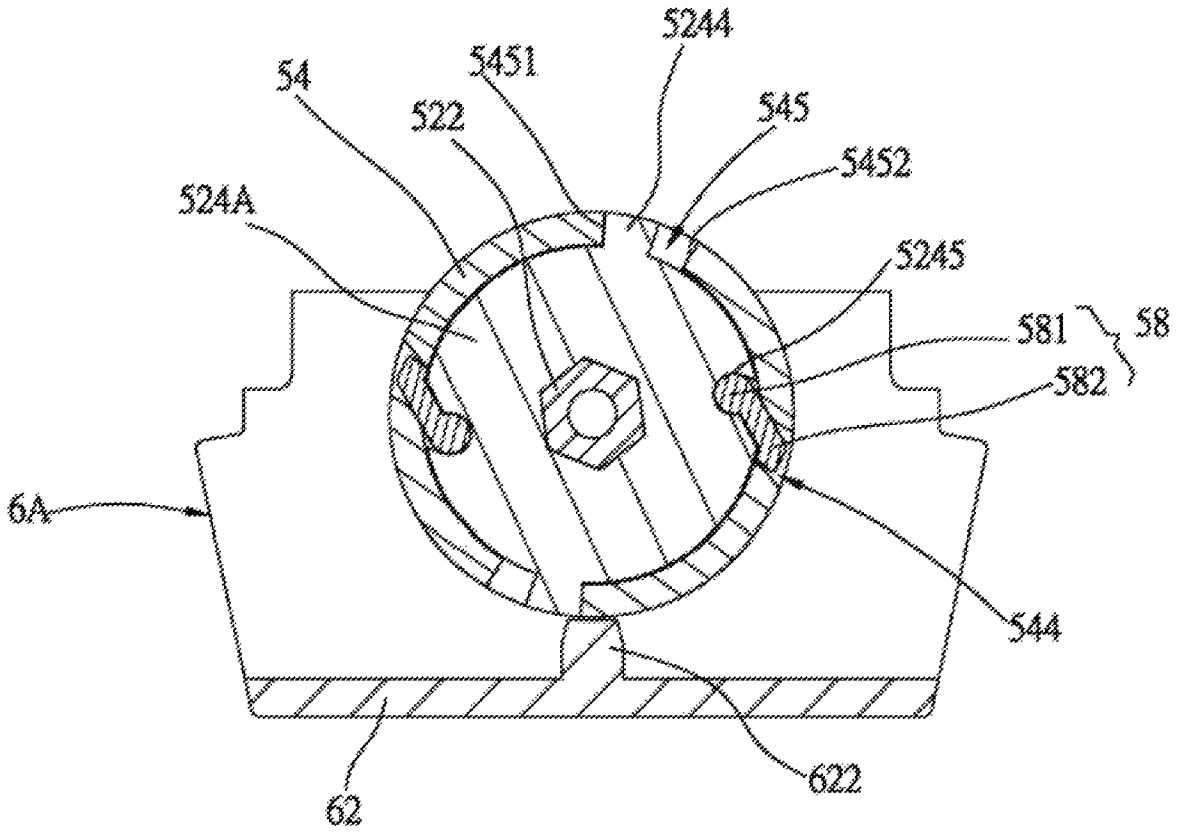
FIG. 5 is a sectional view along line 5-5 of FIG. 3.
Figure 6:
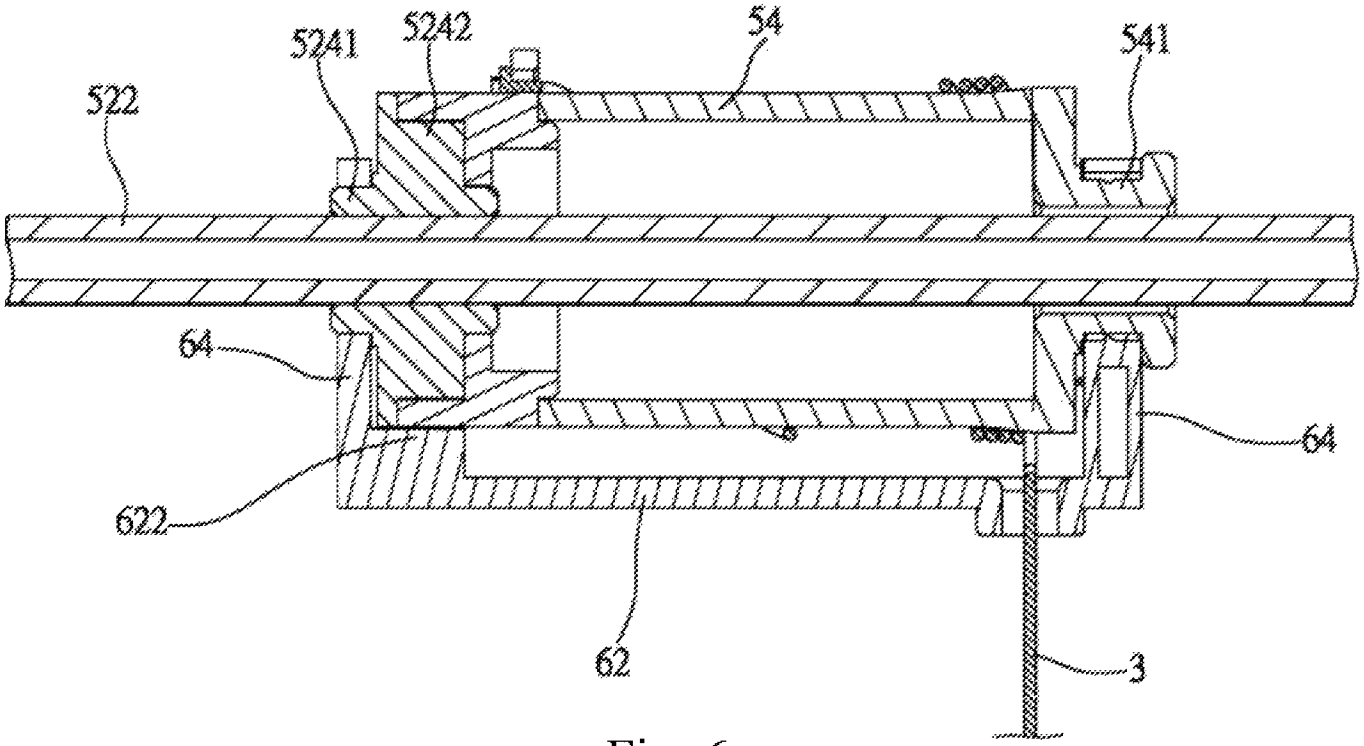
FIG. 6 is a sectional view along line 6-6 of FIG. 3.

The aforementioned is the description of the structure of the window covering 10 according to the preferred embodiment of the present invention. Referring to FIG. 2 and FIG. 3, in the present embodiment, when the rotating shaft 522 is driven by a cordloop 7 to rotate in a first direction D1, the first reel 54 and the second reel 56 are driven simultaneously to rotate in the first direction D1, and respectively wind up the first lifting cord 3 and the second lifting cord 4, whereby to pull the bottom 21 of the covering material 2 to move upward, in order to fold the covering material 2. In contrast, when the covering material 2 is moved downward from the fixed rail 1 by the weight of the covering material 2, the first lifting cord 3 and the second lifting cord 4 respectively drive the first reel 54 and the second reel 56 to rotate in a second direction D2, for the first lifting cord 3 and the second lifting cord 4 are respectively connected to the bottom 21 of the covering material 2, so that the first reel 54 and the second reel 56 respectively keep releasing the first lifting cord 3 and the second lifting cord 4, and thereby the bottom 21 of the covering material 2 would move downward, in order to unfold the covering material 2 smoothly. Regardless of whether the reels 54 and 56 are driven to wind up or release the first lifting cord 3 and the second lifting cord 4, the rotating shaft 522, all of the rotating bases 524A, 524B and the reels 54, 56 are driven by each other to rotate synchronously in the same direction because the humps 5244 of the rotating base 524A are all located in the side hole 545 of the reel 54. In the present embodiment, when the detent 58 rotates in the reel 54, the abutting portion 582 thereof does not protrude from the surface of the reel constantly; for example, the abutting portion 582 goes into the opening 544 of the first reel 54, or is attached on a surface of the rotating base (not shown).

Figure 7:
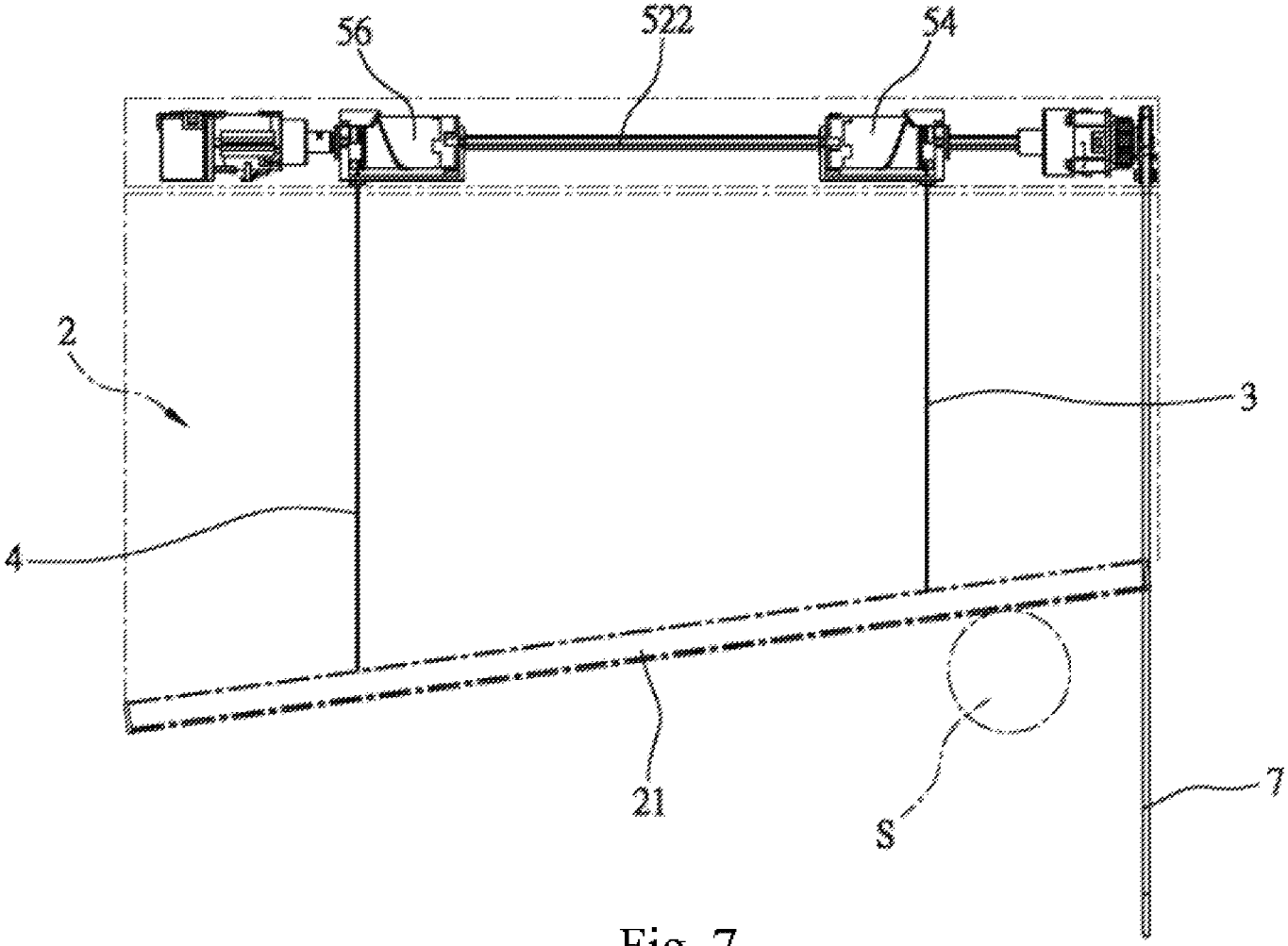
FIG. 7 is a schematic view of the window covering shown in FIG. 1, wherein the window covering meets an obstacle while being unfolded.
Figure 8:
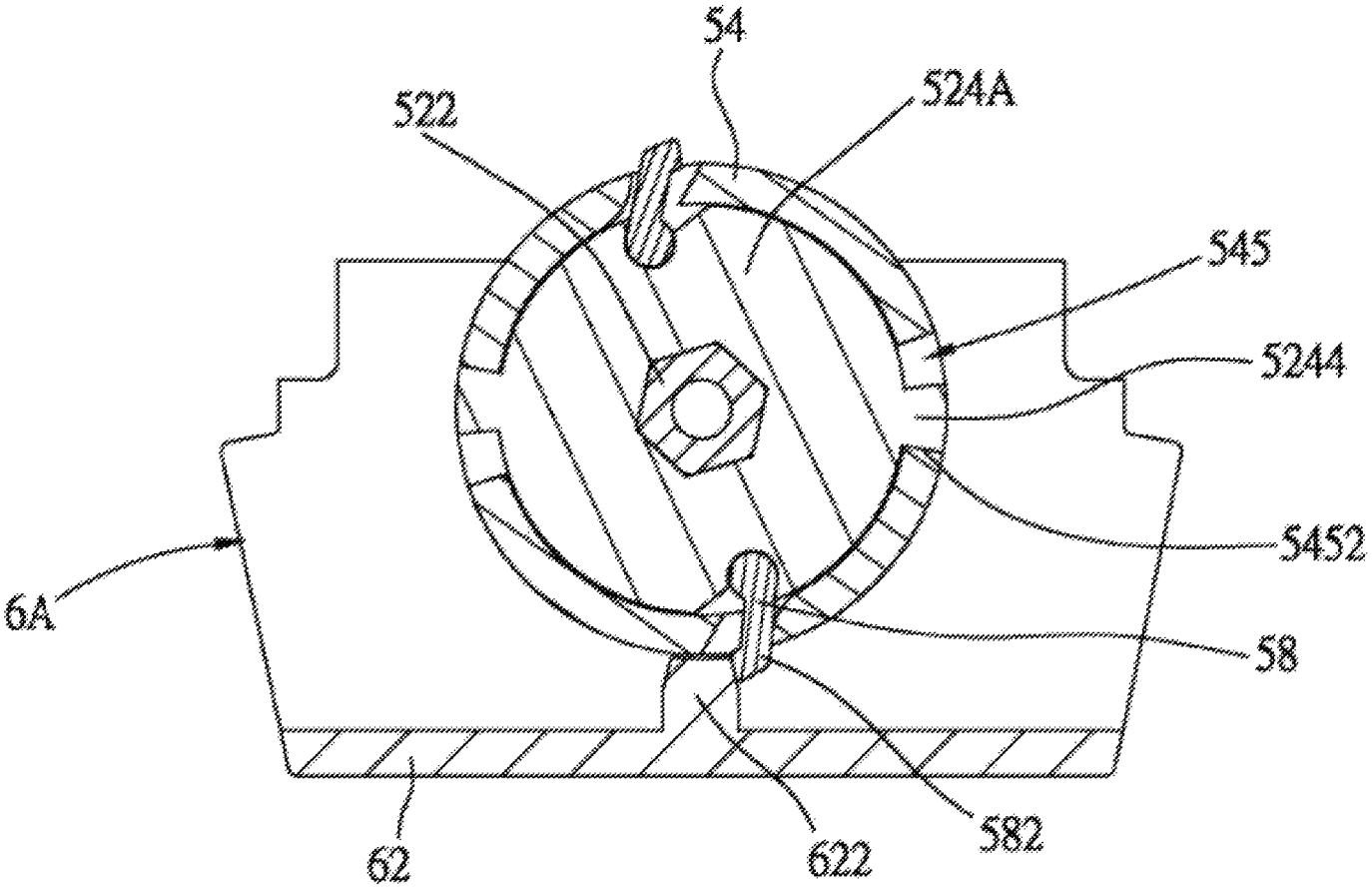
FIG. 8 is similar to FIG. 5.

Referring to FIG. 7 and FIG. 8, when the covering material 2 is moved downward from the fixed rail 1, and the first reel 54 and the second reel 56 are respectively driven by the first lifting cord 3 and the second lifting cord 4 to rotate synchronously in the same direction, in order to synchronously release the first lifting cord 3 and the second lifting cord 4, the bottom 21 of the covering material 2 would touch an obstacle S and be blocked by the obstacle S to stop moving downward if the obstacle S is located on the route of the downward movement of the obstacle S. In FIG. 7, when the obstacle S blocks one side of the bottom 21 of the covering material 2 corresponding to the first reel 54, the side of the bottom 21 of the covering material 2, which is blocked, could not tightly wind up the first lifting cord 3, whereby the released first lifting cord 3 is slack to be wound around the first reel 54, so that the first lifting cord 3 could not drive the first reel 54 to rotate, and the first reel 54 stops rotating. At the moment, for another side of the bottom 21 of the covering material 2 corresponding to the second reel 56 is not blocked, the another side of the bottom 21 of the covering material 2 keeps moving downward, and the second reel 56 driven by the second lifting cord 4 keeps rotating. The second reel 56 also drives the rotating shaft 522 to rotate synchronously in the same direction, so that the rotating shaft 522 could rotate independently from the first reel 54, and the rotating base 524A fixed on the rotating shaft 522 also rotates relative to the first reel 54, in order to force the detent 58 pivoting on the rotating base 524A to rotate along with the rotating base 524A. Therefore, the detent 58 would move toward the opening 544 of the first reel 54, so that the detent 58 would pivot along with the movement. For the pivoting of the detent 58, the abutting portion 582 of the detent 58 protrudes out of the opening 544 through the guiding of the opening 544 of the first reel 54, and the abutting portion 582 protrudes form the surface of the first reel 54 simultaneously, and thereby the rotating shaft 522 could drive the first reel 54 to rotate simultaneously through the detent 58. When the detent 58 rotates along with the rotating base 524A until the abutting portion 582 of the detent 58 abuts against the block 622 of the seat 6A, the rotating base 524A stops rotating, and at the same time, the rotating shaft 522, the first reel 54 and the second reel 56 stop rotating, either. Whereby, the first reel 54 and the second reel 56 completely stop rotating, and stop releasing the first lifting cord 3 and the second lifting cord 4, in order to automatically stop unfolding the covering material.

When the covering material of the present invention is normally unfolded or folded, and the rotating base and the reel are driven to each other to rotate simultaneously, the connecting groove of the rotating base is away from the opening of the reel, and the abutting portion of the detent inserted in the connecting groove is also away from the opening of the reel, and goes into the opening, but does not protrude from the surface of the reel. When the bottom of the covering material is blocked by the obstacle, and the rotating base rotates independently from one of the reel, the rotating base drives the connecting groove to move toward the opening of the reel. Along with the connecting groove moving close to the opening, the pivoting portion of the detent inserted in the connecting groove is pivoted in the connecting groove. When the pivoting portion pivots, the abutting portion of the detent is guided by the opening of the reel to protrude from the surface of the reel. For the abutting portion is guided by the opening, the wall surface of the opening would be apply a guiding force to the abutting portion. The guiding force could not only guide the abutting portion to smoothly pass through the opening, but also increase the pivoting rate, for the direction of the guiding force is just the same as the pivoting direction of the detent, whereby to reduce the time of the abutting portion passing through the opening and moving to protrude from the surface of the reel. According to the design, when the bottom of the covering is blocked, the detent could be driven to pivot and move to protrude from the surface of the reel in a very short time, and timely stop unfolding the covering material according to the blocking of the covering material, in order to prevent the window covering from be damaged.

In the aforementioned embodiment, each of the two reels is connected a lifting cord, but is not limited thereto. As long as the bottom of the covering material is tilted for some reason, the rotating member would rotate independent from the reel to drive the stopper to pivot, whereby one end of the stopper could protrude outward to abut against the stationary block, and therefore, the covering material stops unfolding.

It must be pointed out that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A window covering comprising a fixed rail, a covering material, a lifting cord and a winding mechanism, wherein the covering material is positioned under the fixed rail, and the winding mechanism comprises a rotating member and a reel positioned in the fixed rail; wherein the lifting cord has one end fixed on the bottom of the covering material, and another end thereof is connected to the reel after passing through the covering material and the fixed rail; the reel is driven to wind up or release the lifting cord, in order to drive the covering material to move toward the fixed rail to fold, or to move away from the fixed rail to unfold; characterized in that:

the rotating member passes through the reel, and selectively rotates independently from the reel, or to rotate along with the reel in the same direction synchronously; the winding mechanism further comprises a stopper which is operably pivoted relative to the rotating member; a block is positioned in the fixed rail, and is stationary relative to the fixed rail; when the rotating member rotates independently from the reel, the stopper is driven to pivot, and is protruded from a surface of the rotating member, and the stopper would abut against the block to stop the rotation of the rotating member.

2. The window covering of claim 1, wherein the rotating member includes a rotating base, and the stopper includes a detent; one end of the detent is a pivoting portion pivotably connected to the rotation base, and another end of the detent is formed as an abutting portion; when the rotating base is driven to rotate independently from the reel, the detent is driven by the rotating base, and pivots on the pivoting portion, in order to drive the abutting portion of the detent to move outward from a surface of the rotating base, and thereby the abutting portion would abut against the block, so as to stop rotating the rotating base.

3. The window covering of claim 2, wherein the reel has a bore and an opening; the bore is formed in the reel, and the opening is formed on a surface of the reel, wherein the opening and the bore communicate with each other and are positioned corresponding to the detent; the rotating base enters into the bore, and the detent is driven by the rotating base to selectively go into the opening or go out of the opening.

4. The window covering of claim 3, wherein the rotating base includes a disk; the pivoting portion of the detent is pivotably connected to the disk; the disk enters into the bore of the reel, and the abutting portion of the detent is positioned in the opening of the reel.

5. The window covering of claim 3, wherein the opening of the reel is adjacent to the surface of the rotating base; when the rotating member and the reel rotate synchronously in the same direction, the detent goes into the opening, and the abutting portion of the detent is attached on the surface of the rotating base; when the rotating member rotates independently from the reel, and the detent is driven by the rotating base to face toward the opening, the detent pivots and is guided by the opening, and thereby the abutting portion goes out of the surface of the rotating base, in order to protrude from the surface of the reel through the opening of the reel, whereby to abut against the block to stop rotating the rotating base.

6. The window covering of claim 3, wherein the reel has a side hole; the side hole is defined by a side wall which is an abutting surface, and the side hole communicates with the bore; the rotating base has a hump located in the side hole, and the width of the hump is less than the width of the side hole; when the hump abuts against the abutting surface of the side hole, the rotating base and the reel could rotate synchronously in the same direction.

7. The window covering of claim 6, wherein the side hole is further defined by another side surface which is a restricting surface facing to the abutting surface; when the rotating base is driven to rotate independently from the reel, the hump in the side hole is moved from the abutting surface to the restricting surface, in order to restrict the pivoting range of the detent driven by the rotating base.

8. The window covering of claim 2, wherein the rotating base has a connecting groove recessed in a radial direction thereof, and the abutting portion of the detent is rotatably positioned in the connecting groove; when the abutting portion of the detent rotates independently from the connecting groove, the detent pivots on the pivoting portion, and the abutting portion of the detent is driven to protrude from the surface of the rotating base.

9. The window covering of claim 2, wherein the rotating member further includes a rotating shaft, and the rotating base is fixed on the rotating shaft, in order to be driven by the rotating shaft to rotate.

10. The window covering of claim 1, wherein the window covering further includes a seat fixed in the fixed rail, and the reel is rotatably positioned on the seat, wherein the block protrudes from the seat.

* * * * *